United States Patent [19]

Unger

[11] 4,218,085

[45] Aug. 19, 1980

[54] DEVICE FOR SCREWING IN AND OUT ELECTRICAL LAMPS

[76] Inventor: Henry M. Unger, No. 24, Sunset Dr., Weston, Conn. 06880

[21] Appl. No.: 8,020

[22] Filed: Jan. 31, 1979

[30] Foreign Application Priority Data

Feb. 4, 1978 [DE] Fed. Rep. of Germany ..... 2804764

[51] Int. Cl.[3] ..... H01K 3/32

[52] U.S. Cl. ..... 294/20; 294/64 R

[58] Field of Search ..... 294/19 R, 20–22, 294/64 R, 65.5; 248/362, 363; 269/21

[56] References Cited

U.S. PATENT DOCUMENTS

| | | | |
|---|---|---|---|
| 1,311,776 | 7/1919 | Rodriguez | 294/21 |
| 2,243,106 | 5/1941 | Limbert | 294/20 |
| 2,722,448 | 11/1955 | Popp et al. | 294/20 |
| 2,976,075 | 3/1961 | Budreck | 294/65.5 |
| 3,008,748 | 11/1961 | Rives | 294/64 R |
| 3,033,604 | 5/1962 | Ammon | 294/64 R |

*Primary Examiner*—Johnny D. Cherry

*Attorney, Agent, or Firm*—John C. Smith, Jr.

[57] ABSTRACT

A device provided with a stick for screwing in and out electrical lamps located at an elevated position from a floor comprises a plurality of suction cups arranged circularly at one end of the stick. The suction cups are arranged to be urged against the glass body of a lamp by means of the stick and in doing so by an evacuation of a portion of the air in the suction cups adhering to the glass body of the lamp so firmly that the lamp is able to be screwed in or out. The suction cups are arranged in the interior of an annular head rigidly connected to the stick. An annular body is guided adjustable relative to the lamp on the annular head.

11 Claims, 4 Drawing Figures

FIG.1
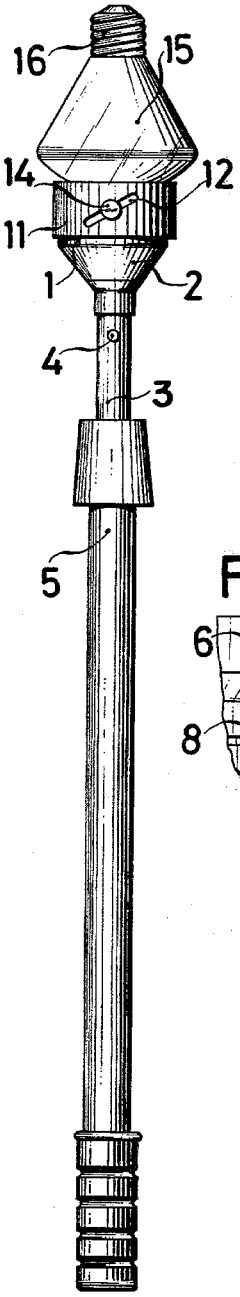
FIG.2
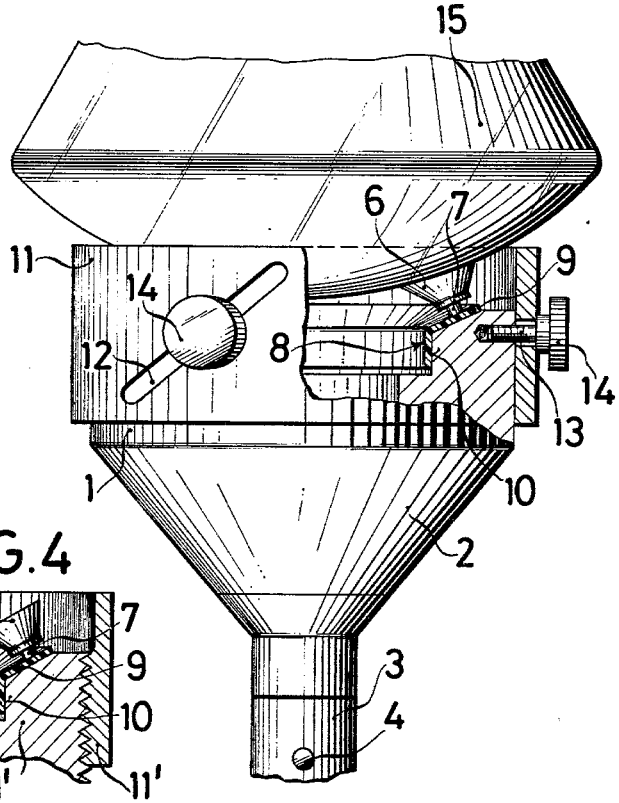
FIG.4
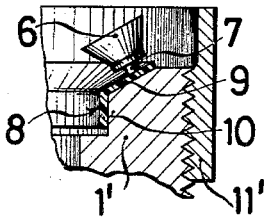
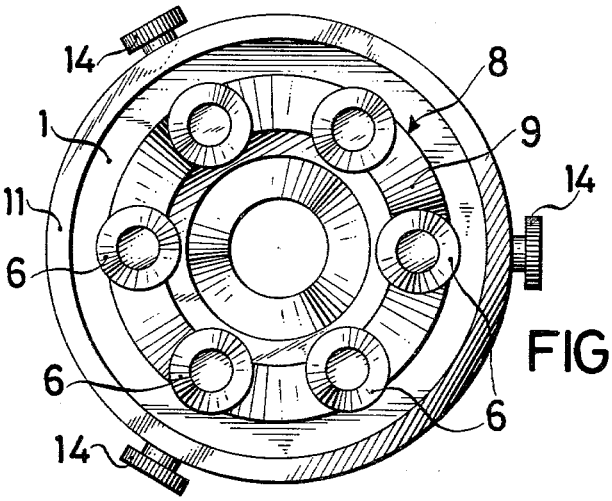
FIG.3

DEVICE FOR SCREWING IN AND OUT ELECTRICAL LAMPS

BACKGROUND OF THE INVENTION

This invention relates to a device for screwing in and out electrical lamps located at an elevated position from a floor, including a stick, a plurality of suction cups arranged circularly at one end of the stick, said suction cups being adapted to be urged against a lamp by means of the stick and in doing so by an evacuation of a portion of the air in the suction cups adhering to the glass body of the lamp so firmly that the lamp is able to be screwed in or out.

Such devices are known (cf. U.S. Pat. No. 2,722,448). The prior art devices have inherent a substantial disadvantage, however, which is the following. Upon urging the suction cups against the glass body of the lamp, a portion of the air within the suction cups is expelled, a vacuum thereby resulting in the suction cups, by which the firm engagement of the suction cups with the lamp body required for screwing it in or out is insured. Practice now has taught that by a pulling action upon the stick of the device the suction cups are not releasable from the lamp body, without at least the risk existing of the lamp body breaking. In the conventional devices therefore, before the device is releasable from the lamp, the vacuum in the suction cups must be relieved by deforming a part of the rims of the suction cups. For this purpose, at the suction cups there are attached in the vicinity of the rims chains with their one ends, which with their other ends are firmly connected to a sleeve sliding on the stick of the device. The sleeve is secured in its initial position by a detent lever spring and capable of being pulled in direction of the rear end of the stick by means of a string guided along the stick of the device. Such devices are complicated in manipulation, however, because for releasing the suction cups from the lamp body the sleeve must be pulled together with the chains and after a releasing of the suction cups must be pushed back into the initial position. They are also relatively complicated in their structure and accordingly expensive in production as a result of the arrangement of the parts required for deforming the suction cups.

SUMMARY OF THE INVENTION

It is the object of the present invention to avoid the aforementioned drawbacks and to provide a device for screwing in and out electrical lamps which is simple in construction and easy to release from the lamps.

To attain this object, the present invention provides a device for screwing in and out electrical lamps located at an elevated position from a floor, comprising (a) a stick; (b) an annular head rigidly connected to one end of the stick; (c) an annular body adjustably encompassing the annular head; (d) means for axially guiding the annular body on the annular head, and (e) a plurality of spaced resilient suction cups arranged circularly in the annular head.

For releasing the suction cups from the lamp, the annular body is brought into engagement with the lower side of the lamp, thereafter the suction cups being released from the lamp by being angularly moved out of the central position by means of the stick of the device. In doing so, an elbow lever is formed between the head provided with the suction cups on the one hand and the stick on the other hand about the tilting point where the head is tilted along with the suction cups, said elbow lever on the one side toward the stick having a long cantilever and on the other side toward the suction cups a short cantilever, thereby the suction cups upon being tilted being released from the lamp easily and without the risk of breaking thereof. In the event the lamp is an incandescent bulb the glass body of which is easily to break and the device must be applied to the glass body, the easy releasing of the device from the bulb is of a particularly advantageous effect.

An advantageous embodiment of the invention is one in which the suction cups are each arranged firmly at one end of a spigot consisting of flexible material.

Thereby, in an advantageous manner a universal movability of the suction cups is achieved. Thereby, the suction cups are conformable to the lamp in such a way that upon being urged against the lamp the underpressure in the suction cups required for a firm engagement with the lamp is reliably produced.

According to another advantageous embodiment of this invention, the suction cups are firmly arranged with their spigots on a circular angular portion of an annular support consisting of flexible material, the annular support being firmly inserted into the annular head of the device and being firmly arranged with its circular angular portion on an inclined portion of the head.

This embodiment of the invention has advantageous effects because the suction cups with their support can be installed in a simple and quick manner. As a result of the inclined position of the suction cups, their conformability to the lamp is further enhanced, particularly, if it has a bulbous glass body.

BRIEF DESCRIPTION OF THE DRAWING

Two embodiments of the invention will now be described by way of example and with reference to the accompanying drawing, in which:

FIG. 1 is a side elevational view of the device as applied to the lower side of a lamp;

FIG. 2 is a partial side elevational view, on an enlarged scale, of the device;

FIG. 3 is a plan view of the front end of the device, the lamp being omitted, and FIG. 4 is a fractional sectional view of another embodiment of the invention.

BRIEF DESCRIPTION OF THE PREFERRED EMBODIMENTS

FIGS. 1 to 3 of the drawing show a device for screwing in and out electrical lamps which comprises an annular head 1 with a truncated-conical hollow extension 2. In the extension 2, one end of a hollow spigot 3 is firmly inserted. In the wall of the spigot 3 in a conventional manner two opposing spring-biased pins 4 are supported. The head 1 is inserted with the spigot 3 into one end of a telescopically extensible rod 5. Upon inserting the spigot 3 into the rod 5, the spring-biased pins 4 snap into holes in the rod 5, thereby the head 1 being arrested in the rod 5. Upon depressing the pins 4, they snap out of the holes in the rod 5 again, the head 1 thereafter being able to be released from the rod 5, if required. The reference numeral 6 designates suction cups consisting of flexible material and being arranged circularly. The suction cups 6 each have a centrically arranged spigot 7 likewise consisting of flexible material. The reference numeral 8 designates an annular support consisting of flexible material, which support has a circular angular portion 9 on which the suction cups 6 are firmly arranged with their spigots 7. The support 8 is firmly inserted into the head 1 at 10 and firmly rests on an inclined portion descending toward the center of the head 1 with its angular portion 9, so that the suction cups 6 are directed inclined toward the center of the head 1. The suction cups 6, the spigots 7 and the support 8 are integral. On the head 1, an annular body 11 encompassing the head 1 is mounted shiftable. Said body 11 is guided adjustable with elongated holes 12 ascending inclinedly along the threaded spigots 13 of clamp screws 14. The clamp screws 14 are capable of being tightened against the annular body 11 for the purpose of arresting the body 11 in the respectively adjusted position. The reference numeral 15 designates a lamp which is provided with a socket 16 with threads. In FIG. 1, the device is shown urged with the suction cups 6 against the lower side of the lamp 15. Furthermore, the annular body 11 is adjusted so far on the head 1 that it engages the lower side of the lamp 15.

As illustrated in FIG. 4 which shows another embodiment of the invention, the annular body $11^1$ may also be guided with internal threads on the head $1^1$ provided with external threads. In this case the clamp screws 14 and thus the elongated holes 12 may be dispensed with.

The invention may be embodied in other specific forms without departing from the spirit or the essential characteristics thereof. The embodiments are therefore to be considered in all respects as illustrative and not restrictive.

What is claimed is:

1. A device for screwing in and out electrical lamps located at an elevated position from a floor, comprising
   (a) a stick;
   (b) an annular head rigidly connected to one end of the stick;
   (c) an annular body adjustably encompassing the annular head;
   (d) said annular body being axially guided on the annular head with elongated holes ascending inclinedly along the threaded spigots of clamp screws guided in the head of the device, and
   (e) a plurality of spaced resilient suction cups arranged circularly in the annular head.

2. A device as set forth in claim 1, wherein the suction cups each are firmly arranged at one end of a spigot consisting of flexible material.

3. A device as set forth in claim 2, wherein the suction cups are firmly arranged with their spigots on a circular angular portion of an annular support consisting of flexible material, the annular support being firmly inserted into the annular head and being firmly arranged with its circular angular portion on an inclined portion of the head.

4. A device for screwing in and out electrical lamps located at an elevated position from a floor, comprising
   (a) an elongated member;
   (b) a rigid head having one side thereof connected to one end of said elongated member;
   (c) at least one resilient annular suction cup mounted on the side of said head opposite said elongated member for engaging the surface of a lamp, the peripheral portion of said at least one suction cup being flexible and unsupported;
   (d) a rigid annular body encompassing said head and said at least one suction cup and having an open annular end in a plane spaced from said opposite side of said body; and
   (e) means for axially adjusting and securing said annular body on said head such that said plane defined by said open annular end of said annular body may be adjusted axially relative to the plane defined by said at least one suction cup;
   (f) whereby said annular body may be adjusted and secured such that the surface of said lamp will simultaneously engage said open annular end of said annular body and said peripheral portion of said at least one suction cup and said open annular end of said annular body will limit relative axial movement between said device and the surface of said lamp towards each other.

5. A device as set forth in claim 4 comprising a plurality of said resilient annular suction cups mounted on said side of said head opposite said elongated member.

6. A device as set forth in claim 4 further comprising a support of flexible material mounted on said side of said head opposite said elongated member, said at least one suction cup being mounted on said flexible member.

7. A device as set forth in claim 6 wherein said flexible member has an annular configuration and a plurality of said suction cups are mounted thereon.

8. A device as set forth in claim 6 wherein said opposite side of said head includes a central cavity surrounded by an annular concave conical portion, said flexible support comprises a central portion supported in said central cavity and an annular concave conical portion surrounding said central portion and supported on said annular concave conical portion of said head, and a plurality of said suction cups are mounted on said annular concave conical portion of said flexible support.

9. A device as set forth in claim 4 wherein said annular body includes a plurality of spaced slots in the side thereof, said device further comprising a plurality of screws passing through said slots into said head to adjustably secure said annular body.

10. A device as set forth in claim 9 wherein said slots are inclined with respect to the axis of said device.

11. A device as set forth in claim 4 wherein said annular body and said head have complementary internal and external helical threads, respectively, for adjusting said annular body.

* * * * *